US009017105B2

(12) United States Patent
Pao et al.

(10) Patent No.: US 9,017,105 B2
(45) Date of Patent: Apr. 28, 2015

(54) ELECTRICAL CONNECTOR AND TERMINAL NETWORK THEREOF

(71) Applicant: Chief Land Electronic Co., Ltd., New Taipei (TW)

(72) Inventors: Chung-Nan Pao, New Taipei (TW); Yu-Hsiung Lin, Pingtung County (TW); Sheng-Hsiang Huang, New Taipei (TW); Yu-Feng Ke, Taoyuan County (TW)

(73) Assignee: Chief Land Electronic Co., Ltd., New Taipei (TW)

( * ) Notice: Subject to any disclaimer, the term of this patent is extended or adjusted under 35 U.S.C. 154(b) by 148 days.

(21) Appl. No.: 13/827,362

(22) Filed: Mar. 14, 2013

(65) Prior Publication Data

US 2014/0273656 A1 Sep. 18, 2014

(51) Int. Cl.

| | |
|---|---|
| ***H01R 24/00*** | (2011.01) |
| ***H01R 13/6471*** | (2011.01) |
| ***H01R 12/72*** | (2011.01) |

(52) U.S. Cl.

CPC ..... *H01R 13/6471* (2013.01); *H01R 12/724* (2013.01); *H01R 12/727* (2013.01); *Y10S 439/941* (2013.01)

(58) Field of Classification Search

CPC . H01R 13/6471; H01R 12/724; H01R 12/727
USPC ..... 439/676, 941, 608, 609, 108
See application file for complete search history.

(56) References Cited

U.S. PATENT DOCUMENTS 7,137,832 B2 * 11/2006 Mongold et al. ..... 439/108

* cited by examiner

*Primary Examiner* — Javaid Nasri
(74) *Attorney, Agent, or Firm* — Li & Cai Intellectual Property (USA) Office

(57) ABSTRACT

The present invention discloses a terminal network of an electrical connector, comprising: a terminal array used to form on a connector surface. The terminal array includes a plurality of terminal rows alternately arranged, wherein each of the terminal rows includes at least one signal transmitting unit and at least one ground unit. Each of the signal transmitting unit and the ground unit is arranged in an alternative form with each other in the same row. Each of the signal transmitting unit and the ground unit in one row are respectively aligned to the ground unit and signal transmitting unit in an adjacent row. By means of the terminal array, crosstalk between or within terminals can be decreased while the use of the ground unit is decreased and the use of the signal transmitting unit is increased.

16 Claims, 9 Drawing Sheets

ELECTRICAL CONNECTOR AND TERMINAL NETWORK THEREOF

BACKGROUND OF THE INVENTION

1. Field of the Invention

The present invention relates to an electrical connector and a terminal network thereof; in particular, to an electrical connector and a terminal network thereof which integrate the arrangement and structure of terminal array.

2. Description of Related Art

Configuration of terminal networks of conventional electrical connectors mainly has two aspects: the array arrangement of electrical contacts on the end portions of the terminals, and the structure of the terminals. The configuration of a network terminal is important for providing an electrical connector with high quality transmission and low crosstalk.

FIG. 1A and FIG. 1B reveal most of the terminal network of an electrical connector. FIG. 1A shows a conventional electrical connector array F which has a 7×7 configuration in a horizontal direction X and vertical direction Y including several ground points GP and signal points SP. However, this method uses an excess amount of ground points GP, and fewer signal points SP. For example, the electrical contact sub-array F1 has relatively few signal points SP and more ground points GP. The large amount of ground points GP is necessary to reduce crosstalk to an acceptable level. However, conventional methods still result in electrical connectors with excess volume.

The structure of the ground points GP and the signal points SP are shown in FIG. 1B. In particular to signal points SP, the first terminal 1 and the second terminal 2 have generally the same form and structure, and are generally parallel to each other from end to end. For example, assume a cutting line cuts the first terminal 1 and the second terminal 2, which are arranged side by side, near their left end portions at two first cutting points (11, 21). Define the distance between the two first cutting points (11, 21) as P. Similarly, assume a cutting line cuts the first terminal 1 and the second terminal 2 near their midsections at two second cutting points (12, 22). The distance between the two second cutting points (12, 22) is essentially equal to P. Described above is the conventional practice and structural arrangement of conventional coupling terminals.

However, even if the copious amount of ground points GP reduces crosstalk or other electromagnetic interference to some degree, crosstalk still persist between neighboring terminals or within terminals, especially when the electrical connector is transmitting data at high speed (e.g. 3 Gbps). In order to transmit large amount of data in a short amount of time, the signal needs relatively high bandwidth. Therefore, the signal operating frequency is very high, possibly between 3 GHz and 5 GHz or even higher. An increase in operating frequency increases the severity of crosstalk, which in turn affects the integrity of data transmission and increases the chance of bit errors.

Therefore, if proper shielding cannot be provided for reducing crosstalk, signal frequency must be reduced, leading to bottlenecking of data transmission and reduction of data transmission frequency. Even if proper shielding can be provided between neighboring terminals, an increase in shielding units and grounding units increases the volume and weight of electrical connectors. This contradicts the current trend of miniaturization of electronic elements, and unnecessarily increases production cost.

Hence, the present inventor believes the above mentioned disadvantages can be overcome, and through devoted research combined with application of theory, finally proposes the present disclosure which has a reasonable design and effectively improves upon the above mentioned disadvantages.

SUMMARY OF THE INVENTION

The object of the present invention is to provide a terminal network of an electrical connector which improves upon inefficient transmission and crosstalk of conventional electrical connectors by configuration of an integrated terminal network. In addition to reducing crosstalk and increasing the quality of signal transmission, the present disclosure can also address the bulky ground shields, increase electrical contact area within the unit, and overall optimizes transmission efficiency.

In order to achieve the aforementioned objects, the present disclosure provides a terminal network of an electrical connector. The terminal network is formed on a connector surface for reducing crosstalk between and within terminals of the electrical connector. The terminal network includes a terminal array with a plurality of terminal rows arranged one after the other. Each of the terminal rows includes at least one signal transmitting unit and at least one ground unit. The signal transmitting unit and the ground unit are alternately arranged within the same row. The signal transmitting unit and the ground unit are also aligned respectively with other ground unit and signal transmitting unit in adjacent rows so that they are alternately arranged in a vertical direction.

In order to achieve the aforementioned objects, the present disclosure provides an electrical connector which includes the terminal network of an electrical connector as mentioned above. The electrical connector includes: a dielectric housing with the signal transmitting unit and the ground unit disposed therein, and the terminal array formed on a face of the dielectric housing.

In summary of the above, the present disclosure improves upon inefficient transmission and crosstalk by integrating structural arrangement of the terminal network.

In order to further the understanding regarding the present invention, the following embodiments are provided along with illustrations to facilitate the disclosure of the present invention.

DETAILED DESCRIPTION OF THE PREFERRED EMBODIMENTS

The aforementioned illustrations and following detailed descriptions are exemplary for the purpose of further explaining the scope of the present invention. Other objectives and advantages related to the present invention will be illustrated in the subsequent descriptions and appended drawings.

Figure 1A:
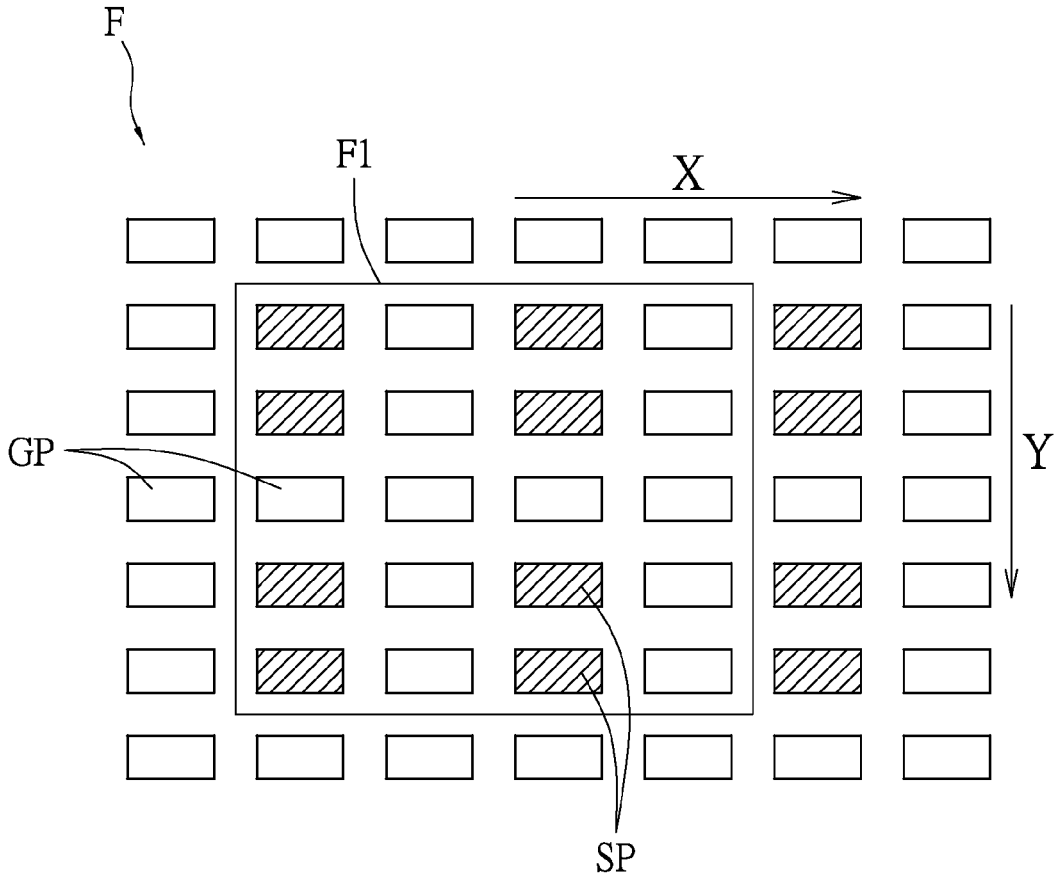
FIG.1A PRIOR ART
FIG. 1A shows a schematic diagram of a configuration of signal transmitting units and ground units of terminal network of a conventional electrical connecter.
Figure 1B:
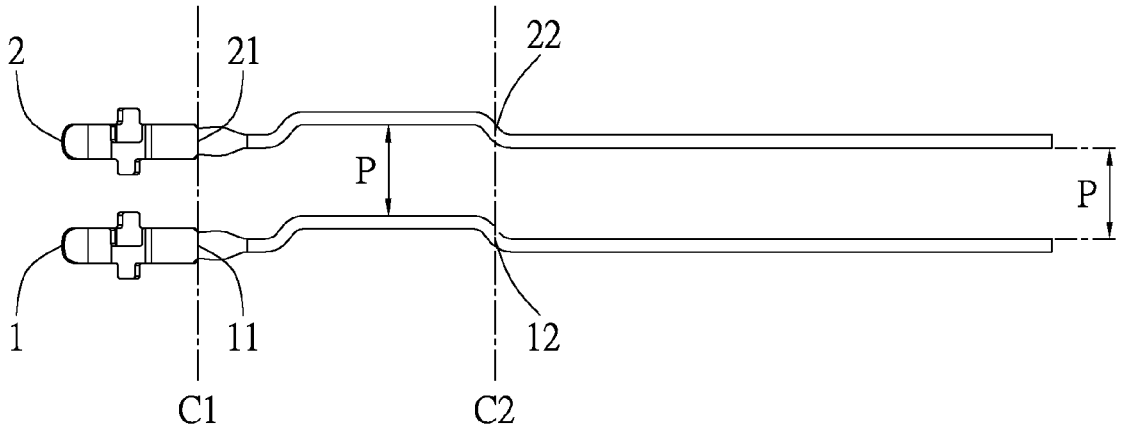
FIG.1B PRIOR ART
FIG. 1B shows a schematic diagram of a terminal network of a conventional electrical connector.
Figure 2A:
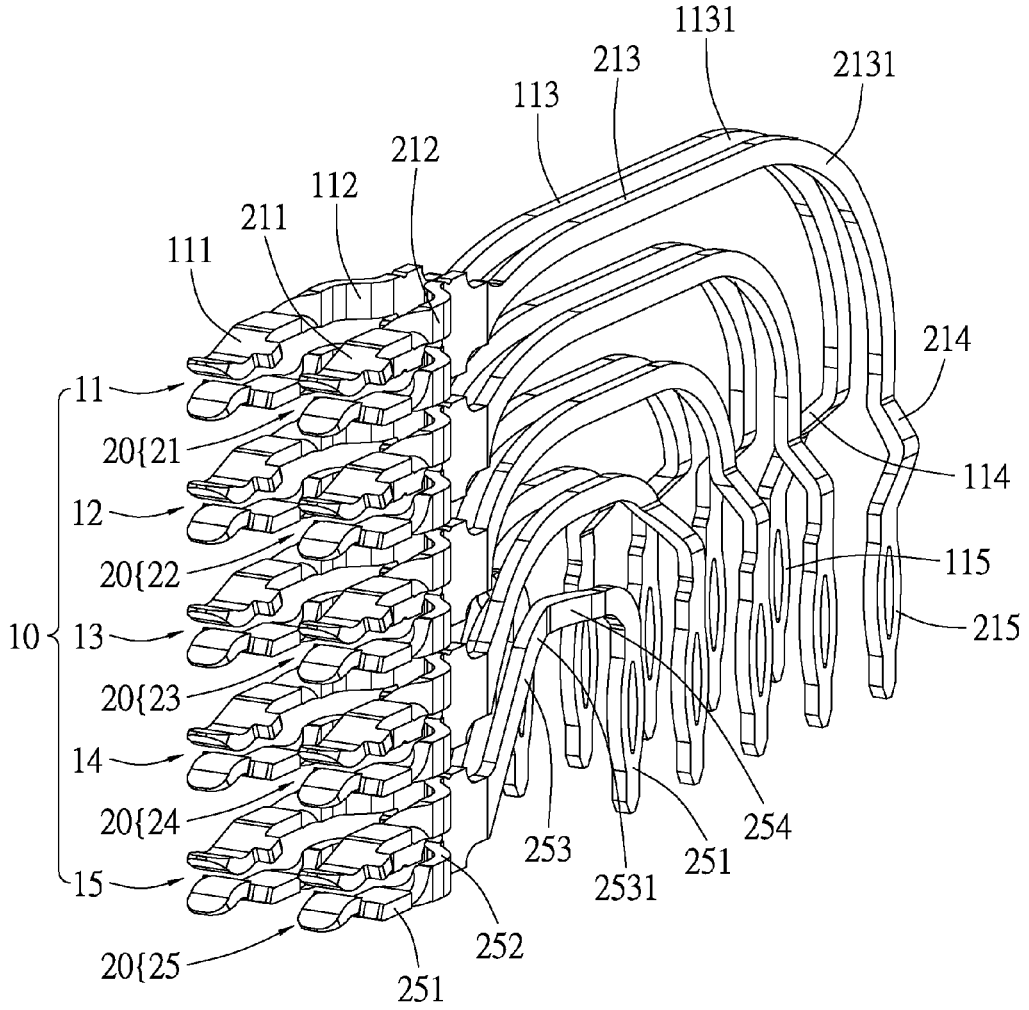
FIG. 2A shows a perspective schematic diagram of a terminal network of an electrical connector of the present disclosure.
Figure 2B:
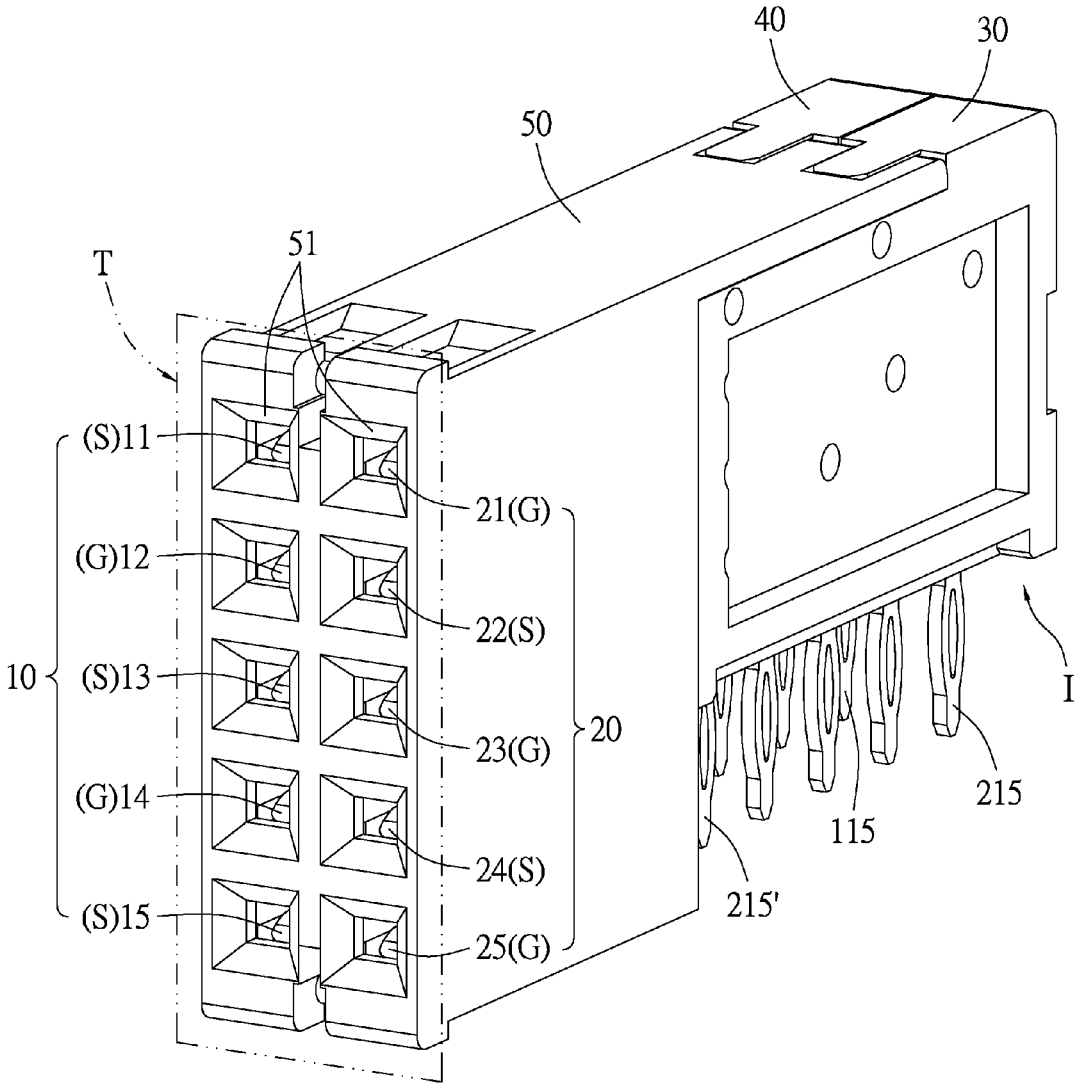
FIG. 2B shows a perspective schematic diagram of an electrical connector of the present disclosure.
Figure 2C:
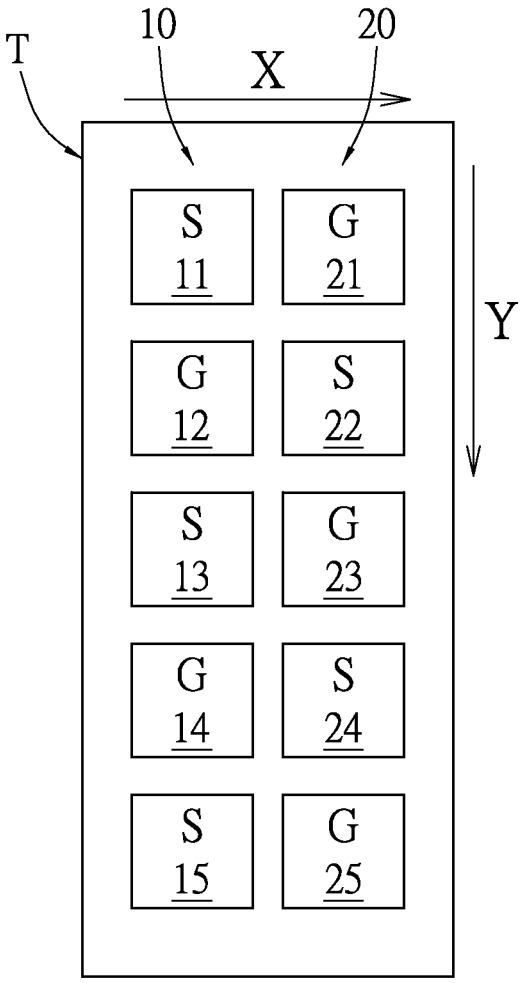
FIG. 2C shows a schematic diagram of a configuration of signal transmitting units and ground units of a terminal network of an electrical connector of the present disclosure.

Referring to FIG. 2A, FIG. 2B and FIG. 2C, the present disclosure provides a terminal network CL of an electrical connector. The terminal network is formed on a connector surface (label omitted) for reducing crosstalk between and within terminals of the electrical connector.

FIG. 2A shows an preferred embodiment of the terminal network but is not intended to limit the same. The terminal network is made of a first terminal group 10 and a second terminal group 20 arranged side by side. Each terminal group has 5 terminals arranged from top to bottom, respectively the first terminals (11, 12, 13, 14, 15) and the second terminals (21, 22, 23, 24, 25), thereby defining a 2×5 terminal array T. Referring to FIG. 2A and FIG. 2B, the terminal network CL can be covered by a dielectric housing I to form an electrical connector. The dielectric housing I can be formed as an integrated body by injection molding, but is not limited thereto. Therefore, in the present embodiment as shown in FIG. 2B, the dielectric housing I is not formed as one body, but comprises a first housing 30, a second housing 40 and a third housing 50. The third housing 50 has a plurality of openings 51. The terminal array T is covered by the third housing 50, matching the openings 51 on a face of the third housing to form an electrical connection interface.

The first terminal 11 and the second terminal 12 are described to illustrate the rest of the first and second terminals in the terminal array T. the first terminal 11 and the second terminal 21 correspond to the openings 51 of the third housing 50, forming a female seat interface for electrical connection interface. The female seat interface can be a gold finger female seat, or a female seat with gripping ability, but can also be modified by the end portions of the first terminal 11 and the second terminal 21 into an interface of other specifications, such as a male interface which can be a gold finger male plug, pin with tear drop shaped hole, or any pins.

Referring to FIGS. 2A, 2B, and 2C, the terminal array T includes a plurality of terminal rows (label omitted) sequentially arranged along the Y-axis (vertical direction). As shown in FIG. 2C, the 2×5 terminal array T has 2 terminals along the X-axis (horizontal direction) and 5 terminals along the Y-axis (vertical direction), but is not limited thereto. Each terminal row includes at least one signal transmitting unit S and at least one ground unit G. The signal transmitting unit S and the ground unit G are alternately arranged horizontally within any terminal row. In other words, as shown in FIG. 2C, the configuration of the first terminal row of the terminal array T is SG, and if extended, the resulting arrangement of the signal transmitting units and the ground units is alternately arranged as "SGSGSGSG". The terminal row is not limited to begin or end with a signal transmitting unit S, and is not limited to begin or end with a ground unit G.

Additionally, each of the signal transmitting unit and ground unit is respectively aligned with a ground unit and a signal transmitting unit in an adjacent row. In other words, in the terminal array T, if any of the terminal rows alternately arranged with signal transmitting unit S and ground unit G has another terminal row arranged adjacent to it in the vertical direction (above or below), each of the signal transmitting unit S in the first terminal row matches a corresponding ground unit G on the adjacent row.

The arrangement method is applicable for terminal arrays of any size such as 2×2, 2×3, 3×2, 3×3, 2×4, 5×2, 5×5, 7×7, etc and is not limited thereto. Ideally, as can be observed from the above configuration, in any two adjacent terminal rows, the amount of signal transmitting units S and the amount of ground units G can be equal. A plurality of peripheral ground units (not shown in the figure) may be disposed on the periphery of the terminal array T, for shielding the signal transmitting units S on the edge of the terminal array T. For example in FIG. 2C, the signal transmitting unit S of the first terminal 13 borders the environment outside the terminal array T. A peripheral ground unit may be arranged at the first terminal 13 for providing a more complete shielding. The first terminal 11, the second terminal 22, etc can be treated similarly.

Preferably a first terminal group 10 and a second terminal group 20 can be defined within the terminal network CL. Taking the first terminal 11 of the first terminal group 10 and the second terminal 21 of the second terminal group 20 for example, the first terminal 11 can be used to define a signal transmitting unit S, and the second terminal 21 can be used to define a ground unit G.

Referring to FIG. 2B and FIG. 2C, the first terminals (11, 13, 15) and the second terminals (22, 24) serving as signal transmitting units S are single-ended signal transmitting terminals for transmitting single-ended signals. The signal transmitting units S are arranged within the terminal array T from the top to bottom along the Y-axis in a left-right-left-right-left zigzag pattern. The first terminals (12, 14) and the second terminals (21, 23, 25) serving as ground units G are ground terminals. The signal transmitting units S are arranged within the terminal array T from the top to bottom along the Y-axis in a right-left-right-left-right zigzag pattern. The two zigzag groups are complementarily arranged within the terminal array T.

Figure 3A:
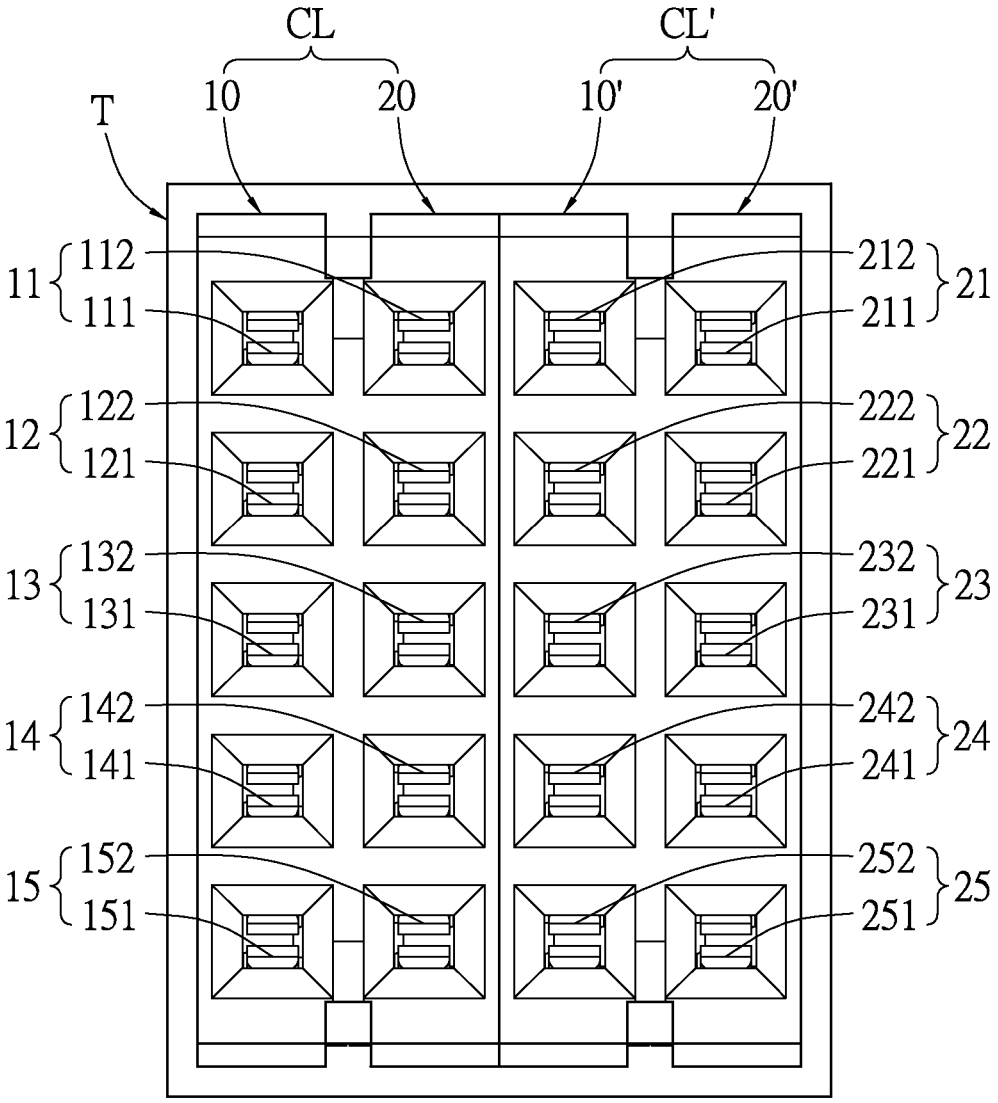
FIG. 3A shows a front view of another embodiment of an electrical connector of the present disclosure.
Figure 3B:
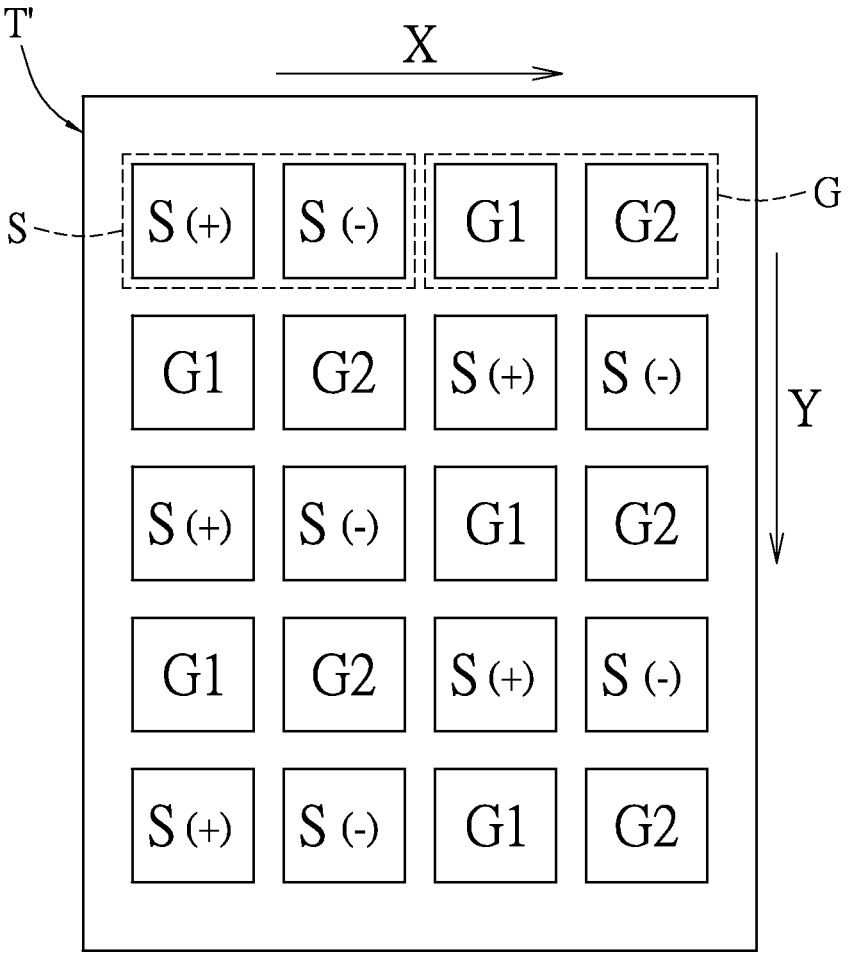
FIG. 3B shows a schematic diagram of a configuration of signal transmitting units and ground units of another embodiment of a terminal network of an electrical connector of the present disclosure.

Construing FIG. 3A and FIG. 3B from FIG. 2B and FIG. 2C, the terminal array T' includes a terminal network CL and a terminal network CL'. Therefore the size of the terminal array T' is 4×5. The signal transmitting unit S and the ground unit G can similarly defined by the first terminal 11 and the second terminal 21 of the terminal network CL. Then the signal transmitting unit S can also be a differential signal terminal pair, including the first terminal 11 and the second terminal 21. In other words, the first terminal 11 and the second terminal 21 together form a differential signal terminal pair (label omitted). The differential signal terminal pair includes a positive differential signal terminal represented by S(+) and a negative differential signal terminal represented by S(−).

In supplemental explanation, even though the first terminals (11, 13, 15) in FIG. 3A all belong to the first terminal group 10 and are signal transmitting units S in the present embodiment, they are not limited to transmitting the same signals. The ground unit G can likewise form a ground terminal pair, including the first terminal 11' and the second terminal 21', exemplified by the first ground unit G1 and the second ground unit G2 of FIG. 3B. In short, as long as aforementioned configuration of ground unit G and signal transmitting unit S in the terminal array T is satisfied, then the amount of terminals defining the ground unit G or the signal transmitting unit S is not limited. In an embodiment with differential signal terminal pair and ground terminal pair, the ground unit G and the signal transmitting unit S each require two terminals to be properly defined, however, the configuration of the signal transmitting unit S and the ground unit G within the terminal array T is still in compliance with the aforementioned characteristic, and correspond to the configuration where the first terminal 11 defines a signal transmitting unit S and the second terminal 21 defines a ground unit G (refer to FIG. 3B). In supplemental note, the 4×5 terminal array T' is not necessarily formed by terminal network CL and terminal network CL'.

Referring to FIGS. 2A, 3A, 3B, and 4, preferably in the terminal network CL of the present disclosure, the first terminal 11 and the second terminal 12 are rendered as in FIG. 2A. The first terminal 11 includes sequentially from one end thereof a first contact portion 111 extending from the terminal array T, a first neck portion 112, and a first extension portion 113. The second terminal 21 includes sequentially from one end thereof a second contact portion 211 extending from the terminal array T corresponding to the first contact portion 111, a second neck portion 212 corresponding to the first neck portion, and a second extension portion 213 corresponding to a first extension portion 113.

The first contact portion 111 and the second contact portion 211 are arranged with a first distance D1 there-between. The first extension portion 113 and the second extension portion are arranged with a second distance D2 there-between. The first distance D1 is larger than the second distance D2. By this configuration, electromagnetic coupling can be created between the relatively close first extension portion 113 and second extension portion 213, such that the transmitted signal can be better protected, reducing interference to the exterior and within itself. Crosstalk between terminals and signal transmission quality of electrical connector are improved. Preferably the first extension portion 113 and the second extension portion 213 each have a wide surface facing each other.

Preferably the first distance D1 to second distance D2 ratio is between 40:7 (5.714) and 40:15 (2.667). Or even better, the first distance D1 is 2 millimeters, and the second distance is 0.55 millimeters. The first terminal 11 and the second terminal 21 can form a differential signal terminal pair, including a positive differential signal terminal, such as the S(+) in FIG. 3B, and a negative differential signal terminal, such as the S(−) in FIG. 3B, which together transmit a differential signal. Alternatively, the first terminal 11 and the second terminal 21 can each be a single-ended signal transmitting terminal for transmitting single-ended signals. Naturally, the first terminal 11 and the second terminal 21 can also be a ground terminal pair and is not further detailed herein.

Figure 4:
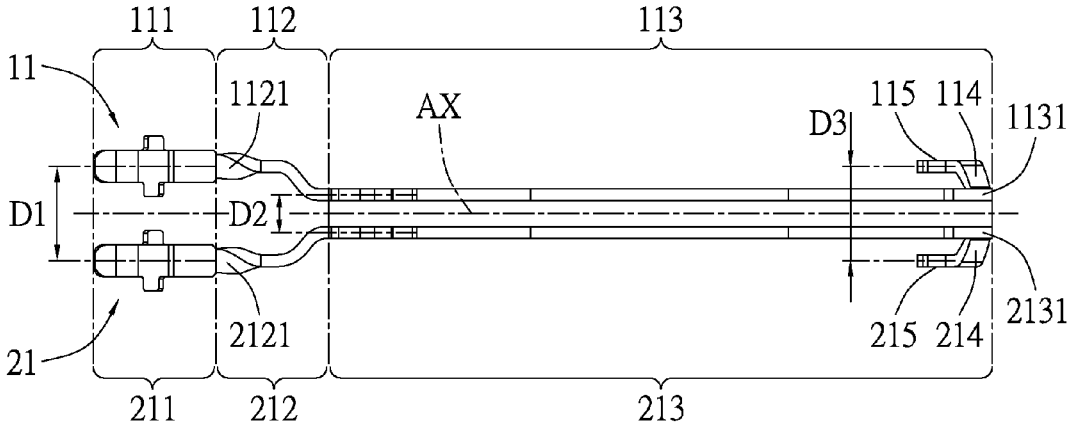
FIG. 4 shows a schematic diagram of a terminal network of an electrical connector of the present disclosure.

Please refer to FIG. 4. In order to improve crosstalk between terminals, the structure between the signal transmitting units S of the terminal network CL of the present disclosure requires the first distance D1 between the first contact portion 111 and the second contact portion 211 to be larger than the second distance D2 between the first extension portion 113 and the second extension portion 213. Taking for example the first terminal 11, as long as the above feature is satisfied, then first neck portion 112 connecting the first contact portion 111 and the first extension portion 113 is not limited to a specific form or structure for connecting the first contact portion 111 and the second extension portion 113. The same applies for the second neck portion 212.

FIG. 4 shows a top view of the first terminal 11 and the second terminal 21 which are symmetrical about plane AX. The other terminals such as those in FIG. 2A can be construed from the first terminal 11 and the second terminal 21, but is not limited to a symmetrical structure. Starting from the first contact portion 111, the first neck portion 112 bends inwardly toward the plane of symmetry AX, and extends to the first extension portion 113. The second neck portion 212 is symmetrical to the first neck portion 112, and also bends toward the plane of symmetry AX and then extends to the second extension portion 213. In order for the first distance D1 to be greater than the second distance D2, the midsection of any terminal is usually manufactured by injection molding to form the first neck portion 112 and the second neck portion 212 bending toward each other or toward the plane of symmetry AX. Thus, the second distance D2 between the first extension portion 113 and the second extension portion 213 following the first neck portion 112 and the second neck portion 212 is naturally smaller than the first distance D1.

Preferably, the first terminal 11 can further extend from the first extension portion 113 to form a third neck portion 114 and a third contact portion 115. In other words, the first contact portion 111 and the third contact portion 115 are respectively positioned at two ends of the first terminal 11.

Similarly, the second terminal 21 can further extend from the second extension portion 213 to form a fourth neck portion 214 corresponding to the third neck portion 114 and a fourth contact portion 215 corresponding to the third contact portion 115. In the present embodiment the third contact portion 115 and the fourth contact portion 215 are both pins with tear drop shaped holes, but is not limited thereto. The third contact portion 115 and the fourth contact portion 215 are the other end portions of the first terminal 11 and the second terminal 21, and can be electrical contacts, pins, male or female plugs of any specification or form. However, most importantly, the third contact portion 115 and the fourth contact portion 215 are arranged with a third distance D3 there-between. The third distance D3 must be larger than the second distance D2. The relative size between the third distance D3 and the first distance D1 is not limited, but preferably the third distance D3 can be equal to the first distance D1. The individual and relative structure of third neck portion 114 and the fourth neck portion 214 are similar to those of the first neck portion 112 and the second neck portion 212, and are not further detailed.

In supplemental explanation, the first distance D1, the second distance D2 and the third distance D3 are defined as follows: taking the first distance D1 for example, the distance is defined as the distance between the central axes (as shown in FIG. 4, label omitted) of the first contact portion 111 and the second contact portion 211. The second distance D2 and the third distance D3 are similarly defined.

Preferably the present disclosure is embodied by a terminal network applicable in a right angle adapter of an electrical connector. The first extension portion 113 can further have a first curved portion 1131 usually curving at a right angle. As shown in FIG. 2A, the curve bends downward but is not limited to such configuration, and can also bend upward, out of or into the page of FIG. 2A. The angle of the curve is likewise not limited herein. Referring back to FIG. 2A, the first curved portion 1131 can guide the orientation of the third contact portion 115 for guiding the orientations of the third contact portion 115 and the first contact portion 111 to be perpendicular. The second extension portion 213 further has a second curved portion 2131 corresponding to the first curved portion 1131. The second curved portion 2131 guides the fourth contact portion 215 to be perpendicular to the second contact portion 211. However, regardless of how the first curved portion 1131 and the second curved portion 2131 bend, the final result must comply with the above condition of having the third distance D3 be smaller than the second distance D2.

However, the first curved portion 1131 may be unnecessary when not used on right angle adapters. Taking for example the second terminal 25 on the bottom of FIG. 2A, the third neck portion 254 directly extends downward from the first extension portion 253 such that the third contact portion 255 ultimately faces downward. The first curved portion 2531 exists but is not very conspicuous.

Figure 5:
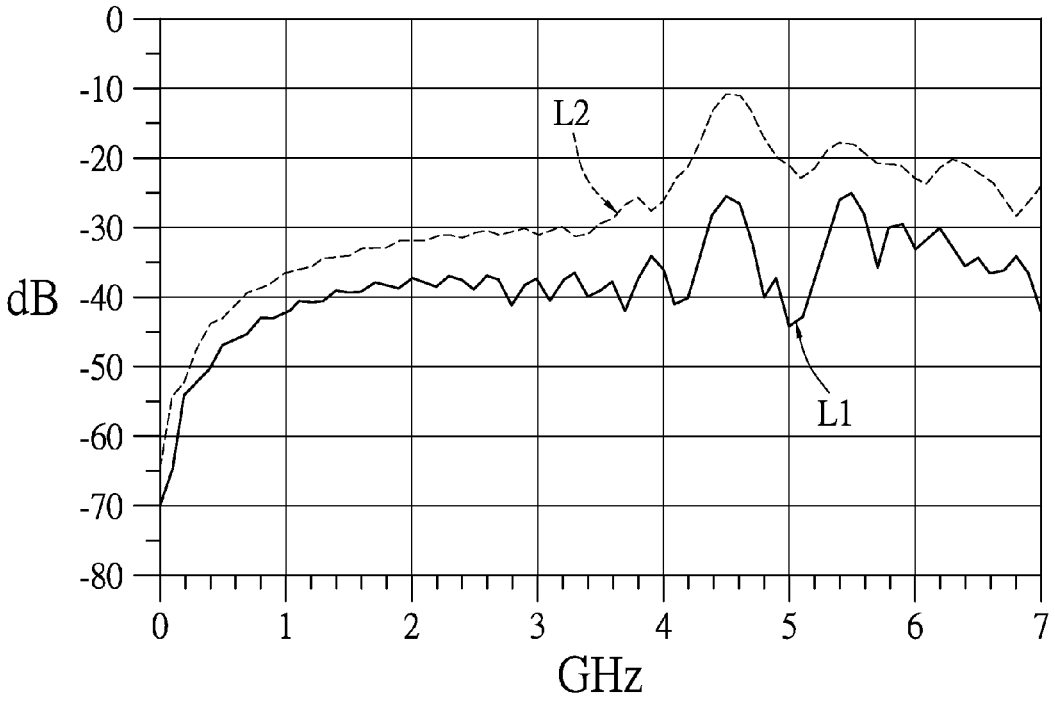
FIG. 5 shows a graph illustrating reduced crosstalk during the signal transmission via the present disclosure.

Referring to FIG. 5, the present disclosure provided by the abovementioned technical features, under the condition that the first distance D1 is greater than the second distance D2 (FIG. 4), can effectively reduce crosstalk between or within terminals. The vertical axis of FIG. 5 is the noise value in decibels (dB). The horizontal axis is the signal frequency in gigahertz (GHz). The first curve L1 is the noise level of crosstalk when the present disclosure transmits signal at varying frequencies. The first curve L2 is the noise level of crosstalk when a conventional coupling terminal structure transmits signal at various frequencies. It can be seen from FIG. 5 that transmitting signal with the present disclosure creates less crosstalk than the conventional terminal does. Therefore, the present disclosure indeed effectively reduces crosstalk and increases the signal to noise ratio (Signal/Noise). The present disclosure is especially applicable on electrical connectors with fewer ground terminals, and is therefore especially applicable on electrical connectors having the abovementioned terminal array T.

Referring to FIG. 2B, the present disclosure provides an electrical connector including the terminal network CL of an electrical connector. The amount of rows of the terminal network CL is not limited. The electrical connector includes: a dielectric housing I with a signal transmitting unit S and a ground unit G disposed therein for fixing the terminals of the signal transmitting unit S and the ground unit G. When the signal transmitting unit S is a differential signal terminal pair, the dielectric housing I can fix the first distance D1 between the extension portions of the positive differential signal terminal S(+) and the negative differential signal terminal S(−), the second distance D2 or the third distance D3. The signal transmitting unit S and the ground unit G can certainly form a terminal array similar to the terminal array T (per FIG. 2B and FIG. 2C) or the terminal array T' (per FIG. 3B) and form an electrical contact interface on any face of the dielectric housing I of the electrical connector.

In summary of the above, the structural integration of the terminal network of the present disclosure can effectively improve upon ineffective transmission and prevent crosstalk, and due to the fewer amount of ground units required, achieves the benefits of reducing weight and volume, greatly aiding the miniaturization of electrical connectors.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. A terminal network of an electrical connector formed on a housing surface for reducing crosstalk within and out of the terminal of the electrical connector, comprising:

a terminal array, including a plurality of terminal rows sequentially arranged along a vertical direction, wherein each of the terminal rows includes at least one signal transmitting unit and at least one ground unit alternately arranged along a horizontal direction, the signal transmitting unit of each of the terminal rows is aligned with the ground unit of any adjacent terminal row along the vertical direction, and the ground unit of each of the terminal rows is aligned with the signal transmitting unit of any adjacent terminal row along the vertical direction;

wherein the signal transmitting unit includes a first terminal and a second terminal in pair, the first terminal includes sequentially from one end thereof a first contact portion a first neck portion and a first extension portion, the second terminal includes sequentially from one end thereof a second contact portion corresponding to the first contact portion, a second neck portion corresponding to the first neck portion, and a second extension portion corresponding to the first extension portion, and the first contact portion and the second contact portion are arranged with a first distance there-between, the first extension portion and the second extension portion are arranged with a second distance there-between, and the first distance is greater than the second distance.

2. The terminal network of an electrical connector according to claim 1, wherein an amount of the signal transmitting unit and an amount of the ground unit in any two adjacent rows are equal.

3. The terminal network of an electrical connector according to claim 1, wherein the signal transmitting unit is a single-ended signal transmitting terminal and the ground unit is a ground terminal.

4. The terminal network of an electrical connector according to claim 1, wherein the signal transmitting unit is a differential signal terminal pair, the ground unit is a ground terminal pair, and the differential signal terminal pair includes a positive differential signal terminal and a negative differential signal terminal.

5. The terminal network of an electrical connector according to claim 4, wherein a periphery of the terminal array has a plurality of peripheral ground units for shielding the signal transmitting unit on the periphery of the terminal array.

6. The terminal network of an electrical connector according to claim 1, wherein the first terminal extends from the first extension portion sequentially a third neck portion and a third contact portion, the second terminal extends from the second extension portion sequentially a fourth neck portion corresponding to the third neck portion and a fourth contact portion corresponding to the third contact portion, the third contact portion and the fourth contact portion are arranged with a third distance there-between, the third distance is greater than the second distance, the first extension portion includes a first curved portion, and the second extension portion includes a second curved portion corresponding to the first curved portion.

7. The terminal network of an electrical connector according to claim 1, wherein the first distance is 2 millimeters, the second distance is 0.55 millimeters, and the first terminal and the second terminal form a differential signal terminal pair including a positive differential signal terminal and a negative differential signal terminal, or two single-ended signal transmitting terminals.

8. The terminal network of an electrical connector according to claim 1, wherein a ratio between the first distance and second distance is between 5.714 and 2.667, and the first terminal and the second terminal form a differential signal terminal pair including a positive differential signal terminal and a negative differential signal terminal, or two single-ended signal transmitting terminals.

9. An electrical connector, comprising:

a terminal array and a dielectric housing, wherein the terminal array includes a plurality of terminal rows sequentially arranged along the vertical direction, wherein each of the terminal rows includes at least one signal transmitting unit and at least one ground unit, the at least one signal transmitting unit and the at least one ground unit are horizontally alternately arranged, the signal transmitting unit of each of the terminal rows is aligned with the ground unit of any adjacent terminal row along the vertical direction, the ground unit of each of the terminal rows is aligned with the signal transmitting unit of any adjacent terminal row along the vertical direction, and the dielectric housing has the signal transmitting unit and the ground unit therein, and the terminal array is formed on a surface of the dielectric housing;

wherein the signal transmitting unit includes a first terminal and a second terminal in pair, the first terminal includes from one end a first contact portion, a first neck portion, and a first extension portion, the second terminal includes from one end a second contact portion corresponding to the first contact portion, a second neck portion corresponding to the first neck portion, and a second extension portion corresponding to the first extension portion, the first contact portion and the second contact portion are arranged with a first distance there-between, the first extension portion and the second extension portion are arranged with a second distance there-between, and the first distance is greater than the second distance.

10. The electrical connector according to claim 9, wherein the first terminal extends from the first extension portion sequentially a third neck portion and a third contact portion, the second terminal extends from the second extension portion sequentially a fourth neck portion corresponding to the third neck portion and a fourth contact portion corresponding to the third contact portion, the third contact portion and the fourth contact portion are arranged with a third distance there-between, the third distance is greater than the second distance, the first extension portion includes a first curved portion, and the second extension portion includes a second curved portion corresponding to the first curved portion.

11. The electrical connector according to claim 9, wherein an amount of the signal transmitting unit and an amount of the ground unit in any two adjacent rows are equal.

12. The electrical connector according to claim 9, wherein the signal transmitting unit is a single-ended signal transmitting terminal, and the ground unit is a ground terminal.

13. The electrical connector according to claim 9, wherein the signal transmitting unit is a differential signal terminal pair, the ground unit is a ground terminal pair, and the differential signal terminal pair includes a positive differential signal terminal and a negative differential signal terminal.

14. The electrical connector according to claim 13, wherein a periphery of the terminal array has a plurality of peripheral ground units, for shielding the signal transmitting unit on the periphery of the terminal array.

15. The electrical connector according to claim 9, wherein the first distance to second distance ratio is between 5.714 and 2.667, and the first terminal and the second terminal form a differential signal terminal pair including a positive differential signal terminal and a negative differential signal terminal, or two single-ended signal transmitting terminals.

16. The electrical connector according to claim 9, wherein the first distance is 2 millimeters, the second distance is 0.55 millimeters, and the first terminal and the second terminal form a differential signal terminal pair including a positive differential signal terminal and a negative differential signal terminal, or two single-ended signal transmitting terminals.

* * * * *